United States Patent [19]

Yasuhara et al.

[11] 4,278,407

[45] Jul. 14, 1981

[54] DEVICE FOR CONTROLLING AN AMOUNT OF FUEL INJECTION IN A DIESEL ENGINE

[75] Inventors: Seishi Yasuhara, Yokosuka; Tsuyoshi Tamazawa; Katsuto Yamauchi, both of Yokohama, all of Japan

[73] Assignee: Nissan Motor Company, Ltd., Yokohama, Japan

[21] Appl. No.: 64,433

[22] Filed: Aug. 7, 1979

[30] Foreign Application Priority Data

Oct. 27, 1978 [JP] Japan ..... 53-148102[U]

[51] Int. Cl.[3] ..... F04B 49/00

[52] U.S. Cl. ..... 417/292

[58] Field of Search ..... 417/289, 292

[56] References Cited

U.S. PATENT DOCUMENTS

| | | | |
|---|---|---|---|
| 2,679,804 | 6/1954 | Bischoff | 417/289 X |
| 3,047,055 | 7/1962 | Kimm | 417/292 X |
| 3,096,716 | 7/1963 | Chmura | 417/292 |
| 3,628,892 | 12/1971 | Eheim | 417/292 |
| 3,637,327 | 1/1972 | Kubiak | 417/292 X |

FOREIGN PATENT DOCUMENTS

| | | | |
|---|---|---|---|
| 2311937 | 12/1976 | France | 417/289 |

*Primary Examiner*—Edward L. Roberts

*Attorney, Agent, or Firm*—Lowe, King, Price & Becker

[57] ABSTRACT

A device for controlling fuel injection in a diesel engine having a distribution type fuel injection pump, wherein injection is controlled to compensate for fuel temperature variation. The device comprises a heat sensitive element having a dimension that varies according to the fuel temperature to adjust fuel injection by displacement of a sleeve of the pump plunger of the pump via a lever. The temperature sensitive element is mounted or linked on an adjusting screw portion of the pump.

4 Claims, 9 Drawing Figures

DEVICE FOR CONTROLLING AN AMOUNT OF FUEL INJECTION IN A DIESEL ENGINE

BACKGROUND OF THE INVENTION

1. Field of the Invention

The present invention relates to a control device for adjusting fuel injection of a diesel engine to compensate for fuel temperature variation.

2. Description of the Prior Art

A conventional diesel engine is generally not equipped with a temperature variation compensation means in its fuel injection pump for controlling fuel flow to match fuel temperature variation. Accordingly, the amount of fuel injection tends to vary with variation of fuel temperature.

In general, if the dynamic viscosity coefficient of the fuel decreases in accordance with a temperature rise, the amount of effective injection decreases due to an increase of fuel leakage in the injecting portion. The relative flow rate of the fuel thus tends to decrease by the variation in injection rate caused by variation of the volume elastic factor and by a decrease of mass per volume by expansion of the volume fuel. Generally a decrease of 9% of flow per 10° C. variation in the fuel temperature results.

The temperature of the fuel varies with atmospheric temperature variation or by the amount of sun radiation incident on the fuel tank. Also since the cooling of the pump is affected by fuel circulating, the fuel temperature varies with the condition of the engine or the driving condition of the vehicle.

FIG. 1 shows variation of characteristic coefficients of an engine as a function of temperature variation. The graph is obtained by normalizing the factor at 30° C. as factor 100 and shows output power and idling rotation. As shown in the figure, if the amount of fuel injection varies due to variation of the fuel temperature, the engine characteristics, for instance the output power and the idling speed of the engine, vary greatly at the upper and lower limits of accelerator operation. For example, if the various dimensions or design factors of the pump are decided by taking the fuel temperature at 30° C. as the standard, the output power might increase by about 20% at a temperature of −20° C. and generate more exhaust. On the contrary, if the fuel temperature rises to 70° C., the output power decreases by about 20% and the idling rotation also decreases by about 10% and this causes an increase in engine vibration. Thus, operation of the conventional diesel engine is degraded by fuel temperature variation. As mentioned above in the FIG. 1, the graph shows in its ordinate the engine characteristic factors, assuming a factor of 100% at 30° C. as 100% and the full line indicates output power and the dotted line indicates number of idling rotation. The abscissa is the fuel temperature plotted in °C.

SUMMARY OF THE INVENTION

The present invention has as one object to improve the aforementioned disadvantages of the conventional diesel engine. More particularly, the present invention provides a fuel injection controlling device for automatically controlling the amount of fuel injection so as to compensate for fuel temperature variation.

DESCRIPTION OF THE PREFERRED EMBODIMENTS

The invention will now be described by referring to the embodiments shown in the accompanied drawings.

Figure 1:
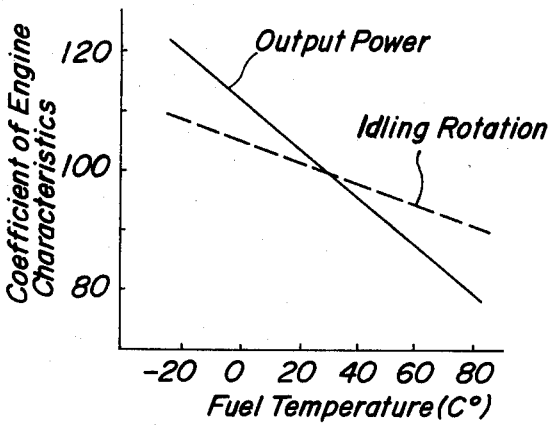
FIG. 1 is a diagram for explaining the relation between fuel temperature and coefficients of the engine characteristics.
Figure 2:
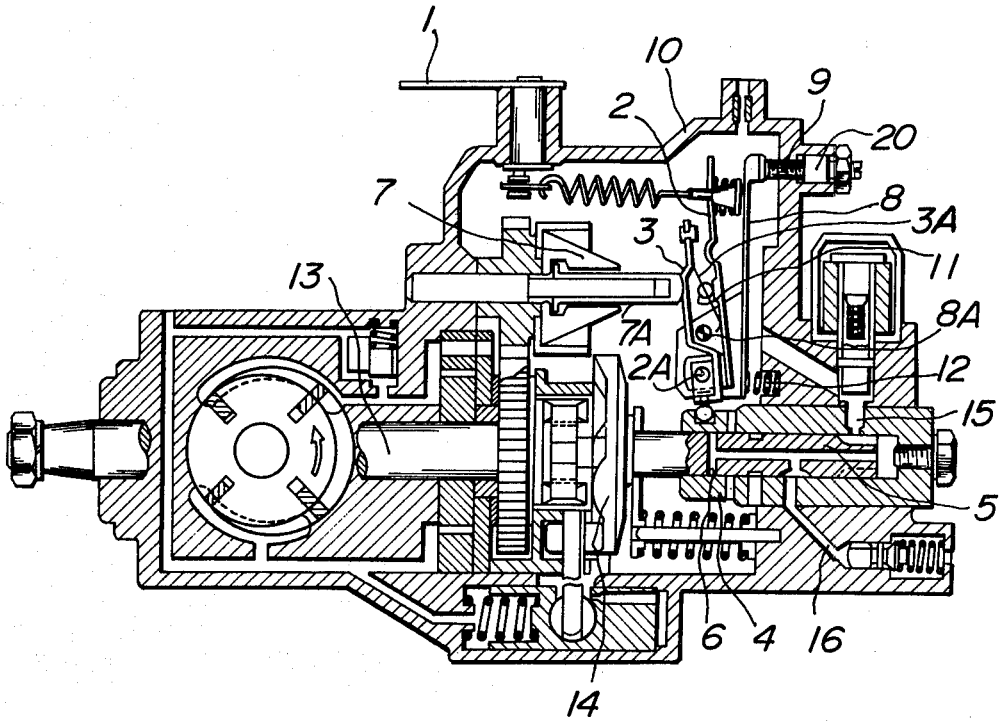
FIG. 2 is a cross-sectional view of a fuel injection pump of a diesel engine according to one embodiment of the present invention.

FIG. 2 is a cross-sectional view of a distribution type fuel injection pump. A lever 1 mounted on a pump housing 10 is controlled by an accelerating pedal (not shown) and drives a control lever 2 to rotate counter clockwise about a support pin 2A.

This movement of the lever 2 is transmitted to a second lever 3 via a leaf spring 3A. A control sleeve 4 coupled to a rotating top end of the second lever 3 is shifted by the movement of the lever 3 along the longitudinal axis of a plunger 5.

This plunger 5 is reciprocated by a reciprocating cam disk 14 which is driven by rotation of a driving axle 13. By the reciprocating movement of the plunger 5, fuel is taken in from an inlet port 15 and is injected through an outlet port 16.

The amount of fuel injection by the pump is controlled to increase or to decrease by controlling the opening and closing time of return path 6 during the injection stroke. Said opening and closing timing is determined by a position of said sleeve 4.

Considering the condition as illustrated in FIG. 2, fuel injection amount will increase by moving the sleeve 4 towards right and thus by retarding the open timing of the return path 6.

Accordingly, if the levers 2 and 3 rotate as mentioned above in response to depression of the accelerator pedal, the sleeve 4 displaces towards the right, and the amount of fuel injection increases.

In FIG. 2, the reference numeral 7 indicates a governor which rotates in synchronism with rotation of the driving axle 13. This governor 7 expands outwardly according to an increase in engine speed and presses the sleeve 7A toward the right.

If the engine speed increases at a certain amount of depression of the accelerator pedal, the lever 3 rotates clockwise about the pin 2A by the sleeve 7A to move the sleeve 4 to the left so as to decrease the amount of fuel injection.

Said supporting pin 2A is mounted on a third lever 8. This lever 8 is pivoted about a pin 8A secured on the housing 10. The bottom end of the lever 8 is biased by a spring 12 and upper end thereof is abutted by an adjusting screw portion 9 screwed in the housing 10.

Said spring 12 applies a bias force to said third lever 8 to rotate the lever clockwise and urges the top of the lever 8 elastically to abut against the adjusting screw portion 9.

If adjusting screw portion 9 is further screwed into the condition as illustrated, the lever 8 rotates counter clockwise and thus the amount of fuel injection is increased.

Reference numeral 11 identifies a stopper for the lever 2 and is formed integrally with the housing 10.

In accordance with the present invention, a heat sensitive element 20 is mounted on this adjusting screw portion 9. By this arrangement, the third lever 8 is driven to rotate in a direction to increase the fuel supply with increase in fuel temperature.

Figure 3:
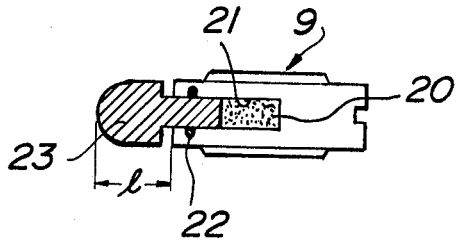
FIGS. 3 to 9 are cross-sectional views for showing various embodiments of a heat sensitive member used in the present invention.

In an embodiment of the present invention shown in FIG. 3, a central bore 21 having a bottom end is provided at the center of the adjusting screw 9. A push rod 23 is inserted in a slideable manner into the bore 21 and at the end of the rod 23 a thermowax pellet is filled to form the heat sensitive element 20.

In the figure, 22 identifies an O-ring for preventing leakage of the wax and also for preventing mixing of the fuel.

According to such a construction, the wax pellet 20 expands according to the temperature rise of the circumference of the pump to push the push rod 23 toward the left so that the sleeve 4 is displaced via the third lever 8. Thus the amount of fuel injection is increased with temperature rise of the fuel. (In practice, the decreasing amount of the flow of fuel according to the temperature rise is compensated).

Figure 4:
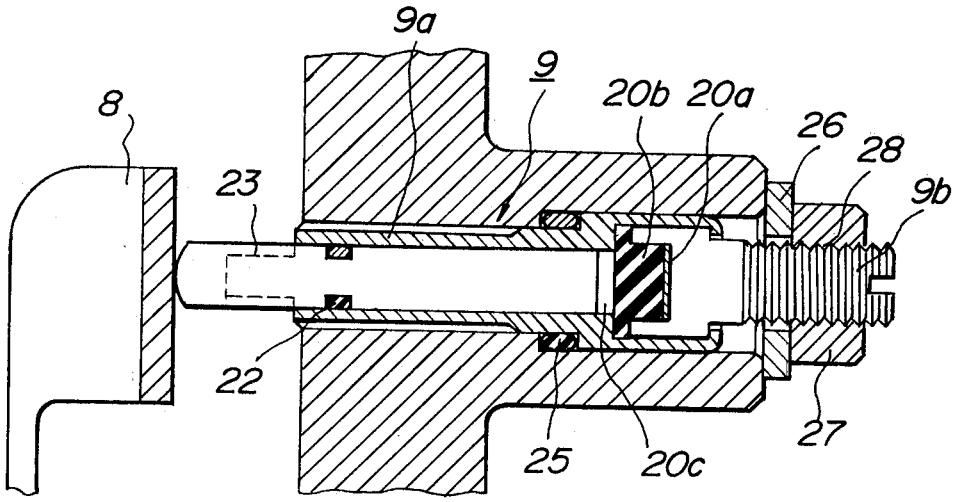

An embodiment shown in FIG. 4 includes a wax pellet 20*a* and a rubber member 20*b* as the heat sensitive element 20. The body of the adjusting screw portion 9 is formed by a stepped hollow cylinder 9*a* and a solid cylinder 9*b*. The two cylinder members are joined together by mechanical caulking with an intervention of the rubber disk 20*b* to seal in the wax pellet 20*a*.

In the drawing, 25 identifies a seal ring, 26 identifies a washer, 27 identifies a nut for tightening and 28 identifies the threaded portion thereof.

This embodiment is advantageous in that sealing of the wax pellet 20*a* is improved and that the thermal expansion of the rubber member 20*b* can also be utilized for displacement of the push rod 23.

In operation, as the wax pellet 20*a* expands during temperature rise, it depresses rubber sealing member 20*b* toward the lift. The sealing member 20*b* deforms by its elasticity and depresses resin plate 20*c* as well as push rod 23. This elastic deformation provides a stroke length in the range of about 0.2 to 0.5 mm.

It is possible to form the heat sensitive element 20 from only the rubber disk 20*b*. Further, resin plate 20*c c* or the like, may be placed between the push rod 23 and the rubber disk 20*b* to prevent leakage of the wax pellet 20*a* even when the rubber disk 20*b* becomes worn.

In any case, as mentioned above, if the heat sensitive element 20 shrinks, the push rod 23 is pressed back by the spring 12 which biases the third lever 8 clockwise in the indicated condition to decrease the amount of fuel injection during low temperature.

Figure 5:
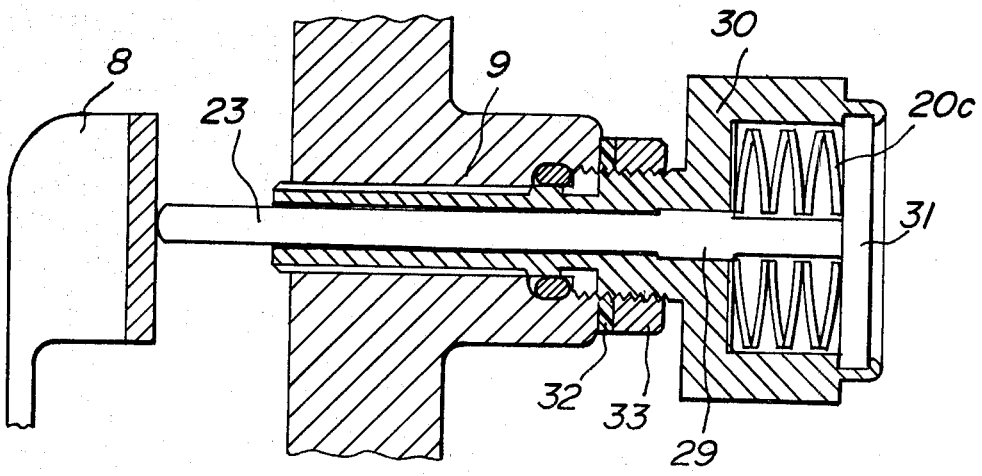

The embodiment shown in FIG. 5 uses a bimetal 20*c* in the form of a washer spring as the heat sensitive element 20. The push rod 23 is provided with a stepped portion 29 at its rear end and a number of washer spring shaped bimetals 20*c* are engaged therewith. The bimetals are contained in a cylindrical container 30 to apply a reactive force to a lid plate 31.

In the figure, 32 is a washer and 33 is a nut for preventing loosening.

The fuel temperature is transmitted to the bimetal 20*c* via the push rod 23. The bimetal 20*c* increases in curvature according to the temperature rise and presses the stepped portion 29 of the push rod 23 to the left.

In practice, the stroke length is sufficient in an range of about 0.2–0.5 mm to obtain a certain desired temperature compensation. This range can be set according to particular requirements.

The embodiments shown in FIGS. 6 to 9 arrange the bimetal 20*d*, 20*e*, 20*f*, 20*g*, respectively, at the side of the third lever 8 so as to improve response to fuel temperature variation.

Figure 6:
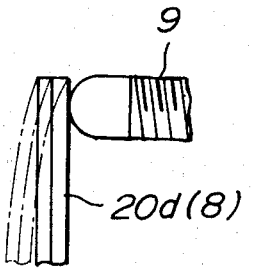

In accordance with the embodiment shown in FIG. 6 the third lever 8 is formed by a plate shaped bimetal 20*d* and the adjusting screw portion 9 is arranged to contact thereon.

During temperature rise, the bimetal 20*d* bends as shown by the dash-dotted line and as a result, the sleeve 4 is moved to the right to increase the flow of fuel.

Figure 7:
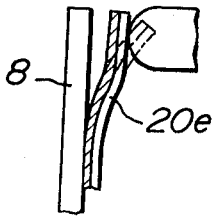

FIG. 7 shows an embodiment wherein a plate shaped bimetal 20*e* is mounted on the third lever 8 itself. This bimetal functions the same as the embodiment shown in FIG. 6.

Figure 8:
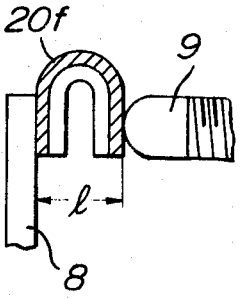

FIG. 8 shows an embodiment in which a U shaped bimetal 20*f* is mounted on the top of the lever 8. In proportion to temperature rise, the interval between the lever 8 and the adjusting screw portion 9 is widened and a similar effect as of the preceding embodiments may be obtained.

Figure 9:
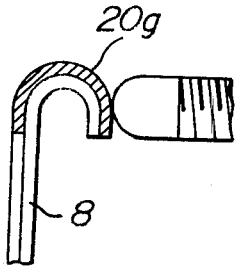

Furthermore another embodiment shown in FIG. 9 forms the top end of the third lever 8 in a U-shaped and onto the U-shaped bent portion a bimetal 20*g* of a corresponding shape is adhered so as to obtain the same function as that of the embodiment shown in FIG. 8.

As has been mentioned in the foregoing, the amount of fuel injection is automatically compensated to meet variations of fuel temperature, according to the present invention. By this means, reduction of output power at high temperature time or increase of exhaust smoke generation and reduction of durability at low temperature by excessive output power may effectively be prevented.

The present invention has a further advantage in that it can be realized in a very simple manner at low cost without affecting the essential adjusting function since the heat sensitive element is provided at only the existing adjusting screw portion or smoke set screw portion in construction.

What is claimed is:

1. A device for controlling an amount of fuel injection in a diesel engine comprising a distribution type fuel injection pump having a pump plunger including a sleeve for controlling the amount of fuel injection being displaced by a lever, and an adjusting screw portion for adjusting an initial position of said lever, wherein the improvement comprises a heat sensitive element for responding to fuel temperature mounted on a mechanical coupling mechanism between said adjusting screw portion and the lever, wherein the amount of fuel injection is adjusted as a function of temperature rise.

2. A device for controlling an amount of fuel injection in a diesel engine as claimed in claim 1, wherein the heat sensitive element comprises thermo-wax for varying an effective length of the adjusting screw portion.

3. A device for controlling an amount of fuel injection in a diesel engine as claimed in claim 1, wherein the heat sensitive element comprises a bimetal for varying an effective length of the adjusting screw portion.

4. A device for controlling an amount of fuel injection in a diesel engine as claimed in claim 1, wherein the heat sensitive element comprises a bimetal for varying an interval between the adjusting screw portion and the lever.

* * * * *